United States Patent [19]

Bailey

[11] Patent Number: 4,949,811

[45] Date of Patent: Aug. 21, 1990

[54] LADDER BRACE

[75] Inventor: William Bailey, Daisy Hill, Australia

[73] Assignee: Bailey Aluminum Products Pty., Ltd., Queensland, Australia

[21] Appl. No.: 413,448

[22] Filed: Sep. 27, 1989

[30] Foreign Application Priority Data

Sep. 29, 1988 [AU] Australia ..... PJ0679

[51] Int. Cl.[5] ..... E06C 7/10; E06C 7/50

[52] U.S. Cl. ..... 182/220; 182/228

[58] Field of Search ..... 182/217, 218, 219, 220, 182/228

[56] References Cited

U.S. PATENT DOCUMENTS

| | | | |
|---|---|---|---|
| 502,967 | 8/1893 | Hetrick et al. | 182/217 |
| 792,436 | 6/1905 | Meacham | 182/220 |
| 1,519,283 | 12/1924 | Wernli | 182/220 |
| 1,838,796 | 12/1931 | Tingleaf | 182/220 |
| 3,083,786 | 4/1963 | Arnold | 182/228 |
| 4,079,814 | 3/1978 | Larson | 182/217 |
| 4,204,587 | 5/1980 | Larson | 182/228 |

*Primary Examiner*—Reinaldo P. Machado

*Attorney, Agent, or Firm*—Renner, Otto, Boisselle & Sklar

[57] ABSTRACT

A ladder brace is provided being substantially channel shaped and having free edges which abut both the step and stile of the ladder. The brace closes off a portion of the stile.

13 Claims, 4 Drawing Sheets

LADDER BRACE

The invention relates to a ladder brace and to a brace in combination with a ladder.

BACKGROUND

It has become the practice to strengthen the stiles of a ladder in at least the region of the lowermost step by providing braces. Typically, the stiles are of U-shaped channel construction where the ladder is made of metal such as aluminum. Each stile had a flat metal strip extending upwardly at an angle from each side flange of the channel section terminating at a respective side edge of the step. The strips were riveted or otherwise secured to the stile and the step. Thus each stile had a pair of braces.

U.S. Pat. No. 2,126,171 illustrates this general arrangement except that the braces extend between the stiles and the second lowermost step and only one brace is associated with each stile.

U.S. Pat. No. 3,009,535 discloses a similar brace configuration.

Such brace configurations are considered undesirable for at least two reasons. These configurations result in a converging space between the brace and stile. Whilst not recommended, users sometimes use the ladder without footwear and should they mis-step or slip from the ladder the converging space has been known to cause the severing of toes. Where such braces are employed higher up the stile there have been instances of the user's fingers being severed.

In addition, such braces have been found deficient in the strength provided and fail in a manner called "fold under" where an impact load caused by the user falling and landing onto the lowermost step is applied to the step. Such failure causes the stiles in the region below the lowermost step to bend. The stiles both typically fold in the same direction with one folding under the ladder and the other folding outwardly and finishing laterally outwardly of the ladder. Typically ladders may be subjected to 1.2KN and should not fail in this way to be acceptable.

The ladder of U.S. Pat. No. 4,204,587 is provided with a brace extending between the side flanges of the channel shaped stile and is secured to the web of that channel and the underside of the lowermost step. The material of the brace is substantial but nevertheless this construction can still result in the severing of toes in the case of the user falling from the ladder.

U.S. Pat. No. 3,083,786 discloses braces in the form of pairs of gusset plates. Whilst this construction does not lead to severing of toes should the user fall, the construction was not sufficiently strong and fold under failure was still possible. Such failure can lead to product liability claims and insurance to guard against this contingency results in insurance costs being reflected in higher initial ladder purchase prices.

In most ladder constructions separate non-skid feet like that shown in FIG. 7 of U.S. Pat. No. 3,083,786 were present and separately fitted to the lowermost end of each stile. This was an added stage in the manufacturing process and added to the eventual cost of the ladder.

OBJECT

It is an object of the present invention to provide a ladder brace which at least minimizes some of the disadvantages referred to above.

It should be appreciated that the brace of the invention can be used with ladders, step ladders and trestles or the like. The invention will be described by way of example in relation to step ladders and the term "ladder" is used herein to denote ladders of all types and includes trestles or the like.

SUMMARY OF THE INVENTION

According to one aspect the invention provides a brace having a step and a pair of spaced channel shaped stiles, said brace having a body portion substantially channel shaped at least along one peripheral face and having peripheral edges along the body portion and in use said brace is receivable within the stile such that the peripheral edges of the channel shaped body portion are in abutment with the stile and the step.

According to another aspect of the invention there is provided a ladder in combination with two braces as described mounted to extend between the lowermost step and the stiles.

The body portion may be channel shaped in its entirety. In one embodiment the body portion has a web and two opposed flanges, the edges of the flanges remote from the web may provide the abutment edge(s). The body portion may be substantially triangular in shape whereby the opposed flanges are substantially triangular although other shapes may also be employed. The free edges of the triangular flanges provide the abutment edges. The edges comprise a first pair of spaced edges for abutment with the step and a second pair of spaced edges for abutment with and for reception within the stile. Whilst it is preferred that the brace fit within the stile in this way conceivably the brace could be reversed such that the web abut the stile with the second pair of edges extending between the step and the stile.

It is preferred that the opposed flanges be substantially planar however one or both of them may be contoured or stepped to lend rigidity to the brace. Preferably both flanges are stepped. Where the flanges are triangular in shape, the flanges may have a triangular stepped portion.

The web of the brace may be substantially planar. Alternatively the web may be stepped or contoured or provided with a strengthening rib. Preferably the web has a longitudinally extending groove or channel formed in it. The channel may have any desired transverse sectional shape but preferably is substantially U-shaped.

The brace may have a bearing foot. The bearing foot may form an extension to one end of the brace. It is preferred that the bearing foot be received within the stile. The bearing foot together with the body portion may, when the brace is fitted relative to a stile, substantially or completely close off or boxed in the stile from a free end thereof to the adjacent step of the ladder.

It is preferred that the bearing foot be channel shaped in transverse cross section. The channel may be substantially U-shaped and have free edges which abut the stile in use. These free edges may form continuations of the second pair of edges of the body portion. Preferably the channel has opposed flanges which form continuations to the flanges of the body portion. The channel may have a web which forms an extension to the web of the body portion. It is preferred that the web be planar and that the flanges be configured for reception within the channel shaped stile.

The brace may be formed integral with a foot pad member. The pad member, when the ladder rests upon the ground, engages the ground to provide a measure of slip resistance. The pad member may be formed as a separate component to the brace and be attached thereto. Where the brace has a bearing foot, the pad member may be secured thereto or formed integral with that foot. Any suitable means for securing the pad member may be used. Fasteners or an adhesive may be employed.

Clearly, a ladder has two stiles and a respective brace may be fitted relative to both stiles. Where the ladder has parallel stiles, the two braces may be interchangeable. Where the ladder has non-parallell stiles such as in a step ladder the braces may be handed and not be interchangeable.

The braces may be secured to the ladder in any suitable way. Fasteners or an adhesive may be employed. Welding may be an option, depending upon the material from which the braces are made. The braces may be made of metal or plastics material although the latter is preferred.

BRIEF DESCRIPTION OF THE DRAWINGS

A particular preferred aspect of the invention will now be described with reference to the drawings in which:

FIG. 1 shows part of a step ladder 10 having two converging stiles 11, 12. Each stile has a or rung foot 13. The lowermost step 14 and the second lowermost step or rung 15 are shown. While the figure shows a step ladder, it should be appreciated that the invention is also applicable to other ladders with parallel stiles or extension ladders.

Figure 1:
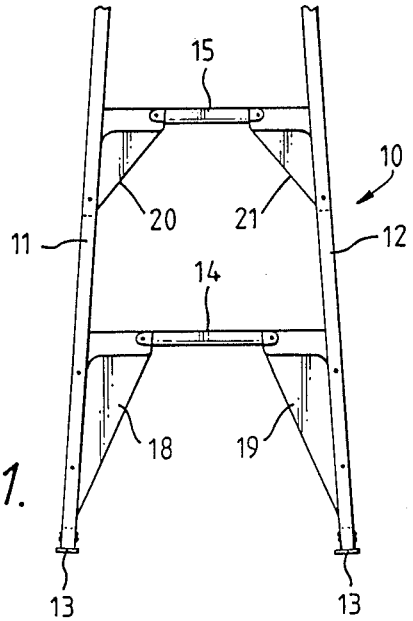
FIG. 1 is an elevational view of part a ladder having braces according to an embodiment of the invention.

The ladder in FIG. 1 is provided with braces 18, 19 extending between step 14 and the stiles 11, 12 and braces 20, 21 extending between step 15 and stiles 11, 12. Because stiles 11, 12 converge, the braces are "handed". Clearly, where the stiles are parallel this is not the case.

In FIGS. 2, 7, 8 and 9 greater detail of the brace 18 is shown in FIG. 1. Brace 19 of FIG. 1 has similar features except it has a mirror symmetrical configuration.

The stile 11 is substantially U-shaped and has two side flanges 25, 26 and a web 27. The step 14 has the configuration shown with two oppositely and outwardly directed lips 28, 29 an upper tread 30 and two box shaped portions 31, 32. Clearly, the shape of the step and the stile are not central to the invention and may be varied.

The brace 18 has a body portion 34 and a foot portion 37. The body portion 34 is substantially channel shaped. Peripheral edges 38 and 39 (see FIG. 7) are substantially L-shaped having sections 40 and 41. Section 40 of each peripheral edge abuts the underside of lips 28, 29 of the step 14 while section 41 of each peripheral edgs abuts web 27 of the stile 11. In this way added rigidity and strength to resist impact loads to the step is afforded to the ladder.

The body portion 34 has spaced faces 45, 46 which in this embodiment are triangular and stepped at corners 42, 43. The body portion 34 has a web 44 provided with a channel 47. The steps and the channel add strength to the body portion. The foot portion 37 has two spaced flanges 48, 49 for receiving the foot 13. Apertures 50 enable fasteners 51 to be secured to the foot portion 37 to attach the foot 13.

Figure 2:
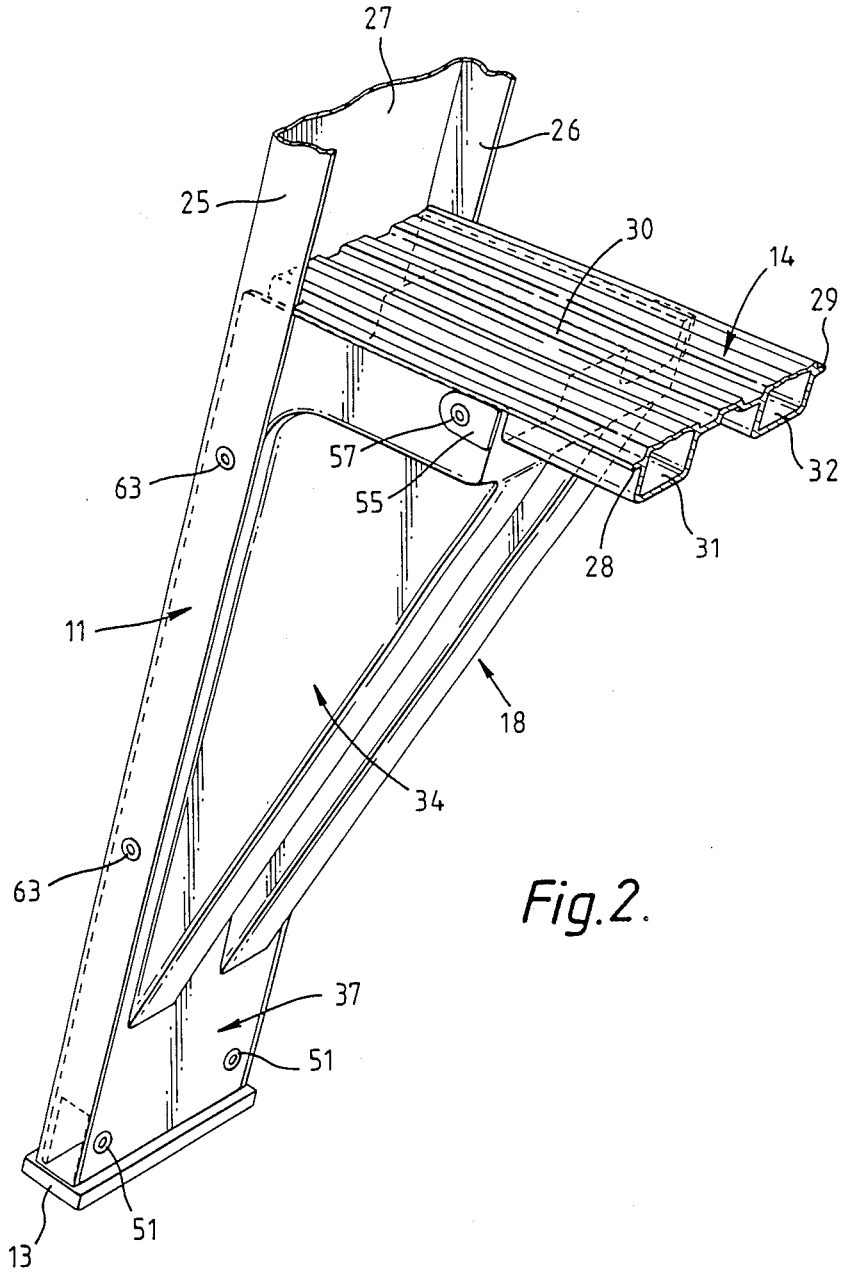
FIG. 2 is a perspective view of a ladder brace according to one embodiment of the invention.

From FIG. 2 it can be seen that the braced 18 completely closes off or boxes in the lower end of the stile. By having edges 38 and 39 in contact with the step and stile impact forces on the step are resisted.

The brace 18 has raised portions or bosses 55 with apertures 56 for receiving fasteners 57 to facilitate attachment of the brace to the step.

Recessed 60 with return wings 61 receive washers (not shown) to strengthen the portion of the brace adjacent apertures 62. Apertures 62 receive fasteners 63, which fix the brace to the stile.

Figure 4:
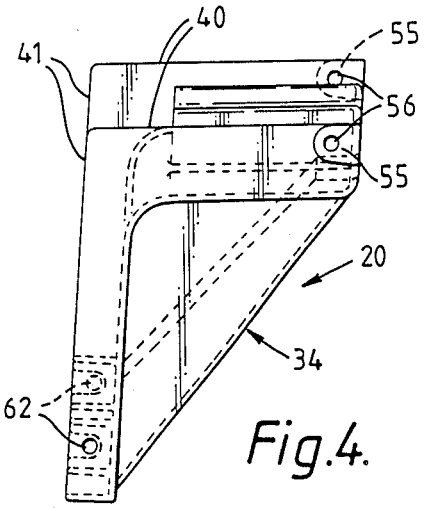
FIG. 4 is a further view of the brace of FIG. 3.
Figure 5:
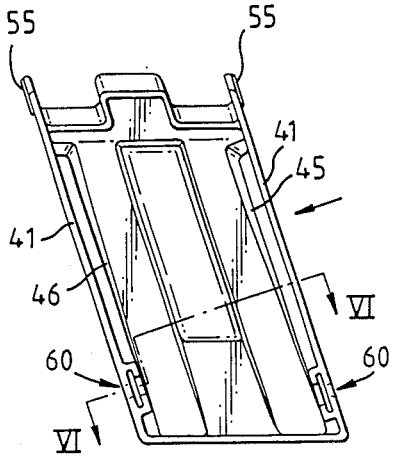
FIG. 5 is a side view of the brace of FIG. 4.
Figure 6:
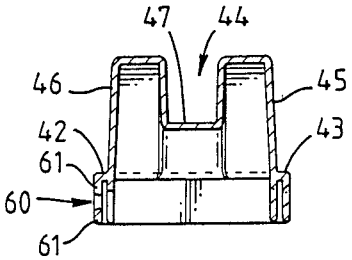
FIG. 6 is a sectional view taken along line VI—VI of FIG. 5.
Figure 3:
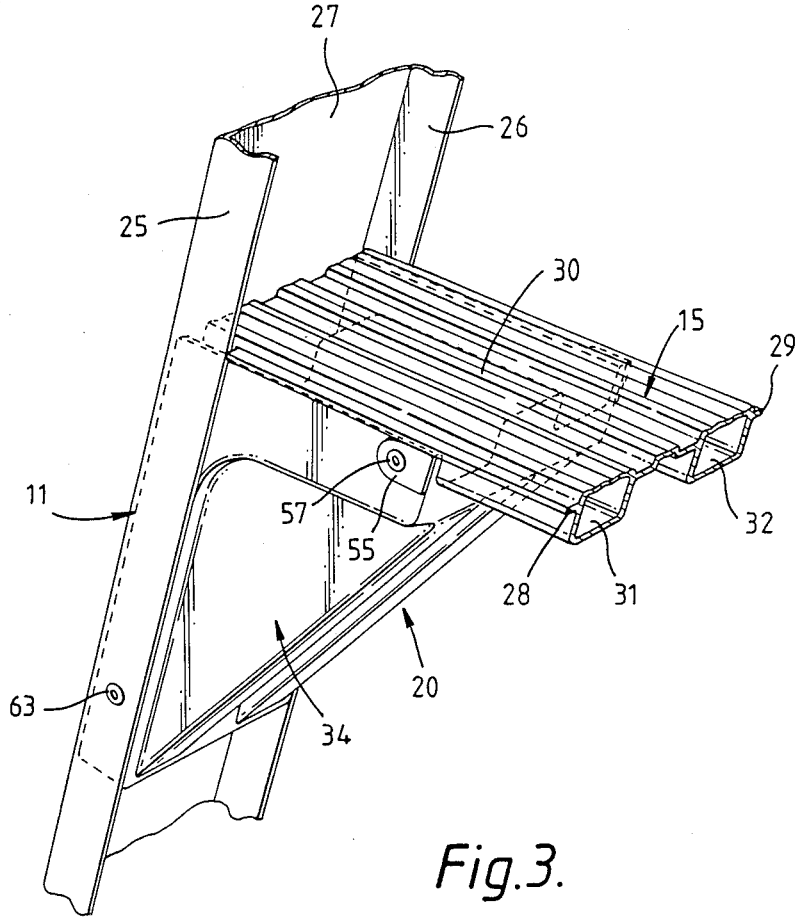
FIG. 3 is a perspective view of a ladder brace according to another embodiment of the invention.
Figure 9:
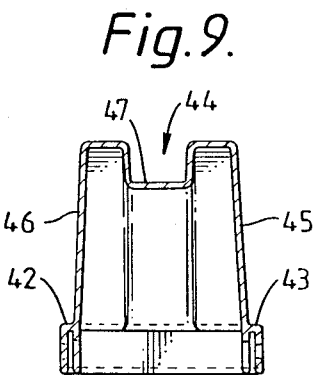
FIG. 9 is a sectional view taken along line IX—IX of FIG. 8.
Figure 8:
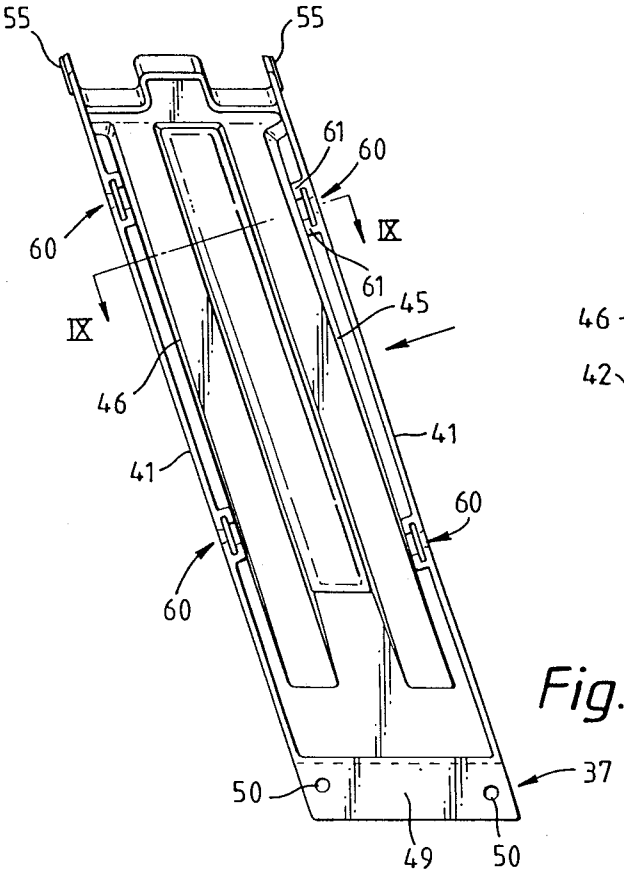
FIG. 8 is a side view of the brace of FIG. 7.
Figure 7:
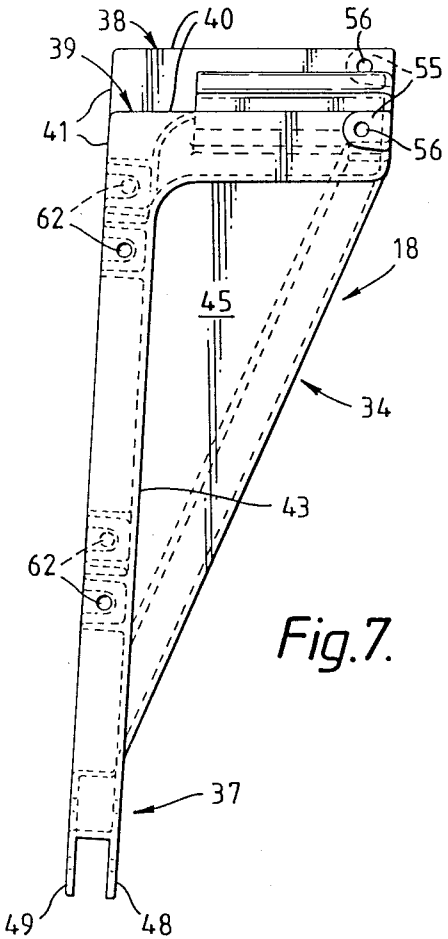
FIG. 7 is a further view of the brace of FIG. 2.

The brace of FIGS. 3 to 5 is similar to the brace of FIGS. 2 and 7 to 9 except that it does not have a foot portion, the body portion is not as large and only two apertures like aperture 62 are present for fixing the brace to the stile. Like features of brace 20 are given the same numerals as the features of the brace 18.

Aperture 56 in brace 20 enables that brace to be fixed to step 15 by fastener 57. Fasteners 63 enable the brace 20 to be sourced to the stile.

It should be appreciated that a ladder may just be provided with braces 18, 19 adjacent the lower step 14. Alternatively, the ladder in addition to having braces 18, 19 may also have braces 20, 21 associated with the second lowermost step or indeed other or all other steps of the ladder.

The brace of the invention provides a greater resistance to impact damage than braces of the prior art. It should be appreciated that a ladder has two stiles and that a brace like that illustrated is associated with each stile.

I claim:

1. A brace for a ladder having a step and a pair of spaced channel shaped stiles, said brace having a body portion substantially channel shaped at least along one peripheral face and having peripheral edges along the body portion and in use said brace is receivable within the stile such that the peripheral edges of the channel shaped body portion are in abutment with the stile and the step.

2. The brace of claim 1 wherein the body portion has a web and two opposed flanges and the free edges of the flanges provide said peripheral edges.

3. The brace of claim 2 wherein the flanges of the body portion are substantially triangular in shape.

4. The brace of claim 2 wherein the flanges have a stepped triangular portion.

5. The brace of claim 2 wherein the web of the brace has a longitudinally extending strengthening channel.

6. The brace of claim 2 wherein the peripheral edges are L-shaped and said edges are provided by free edges of the flanges, said peripheral edges including two edge portions at substantially right angles to one another.

7. The brace of claim 2 wherein said flanges of the body portion are provided with apertures for fixing the brace to the steps and stiles of the ladder.

8. The brace of claim 7 wherein the fixing apertures for fixing the brace to the stile having associated recesses for receiving washers.

9. The brace of claim 1 including a foot portion depending from the body portion adapted for receving a bearing foot.

10. The brace of claim 9 wherein the foot portion includes two spaced foot receiving flanges which in use extend across the stile.

11. A ladder including at two said braces according to claim 1 secured to extend between a lowermost step of the ladder and the stiles of the ladder.

12. The ladder of claim 10 including a bearing foot mounted to the foot portion of each said brace.

13. A ladder including two said braces according to claim 1 secured to at least a second lowermost step of the ladder.

* * * * *